US008955609B2

(12) United States Patent
Phillips et al.

(10) Patent No.: US 8,955,609 B2
(45) Date of Patent: Feb. 17, 2015

(54) STORAGE TANK FIRE SUPRESSION SYSTEM

(71) Applicants: C. Allen Phillips, Rising Star, TX (US); Ivan Paul Rogers, III, Buda, TX (US)

(72) Inventors: C. Allen Phillips, Rising Star, TX (US); Ivan Paul Rogers, III, Buda, TX (US)

( * ) Notice: Subject to any disclaimer, the term of this patent is extended or adjusted under 35 U.S.C. 154(b) by 165 days.

(21) Appl. No.: 13/836,162

(22) Filed: Mar. 15, 2013

(65) Prior Publication Data

US 2013/0206428 A1 Aug. 15, 2013

Related U.S. Application Data

(63) Continuation-in-part of application No. 12/291,692, filed on Nov. 13, 2008, now abandoned.

(51) Int. Cl.

| | |
|---|---|
| ***A62C 13/62*** | (2006.01) |
| ***A62C 31/00*** | (2006.01) |
| ***A62C 3/06*** | (2006.01) |
| ***A62C 35/13*** | (2006.01) |
| ***A62C 37/11*** | (2006.01) |
| ***A62C 99/00*** | (2010.01) |
| ***A62C 5/02*** | (2006.01) |

(52) U.S. Cl.

CPC ..... *A62C 31/00* (2013.01); *A62C 3/065* (2013.01); *A62C 35/13* (2013.01); *A62C 37/11* (2013.01); *A62C 99/0036* (2013.01); *A62C 5/022* (2013.01)

USPC ..... 169/66; 169/68; 169/71; 169/60; 169/74

(58) Field of Classification Search

USPC ..... 169/66, 68, 30, 71, 60, 74

See application file for complete search history.

(56) References Cited

U.S. PATENT DOCUMENTS

| | | | | |
|---|---|---|---|---|
| 2,514,439 | A * | 7/1950 | Fisher et al. | 169/68 |
| 4,838,356 | A * | 6/1989 | Akatsu | 169/66 |
| 5,904,190 | A * | 5/1999 | Patel | 141/198 |

* cited by examiner

*Primary Examiner* — Dinh Q Nguyen

(74) *Attorney, Agent, or Firm* — Megan E. Lyman

(57) ABSTRACT

The present invention relates to automatically activated fire suppression system providing a system that releases fire suppressant foam, or aqueous film forming material ("AFFF") over a flammable material contained within a storage tank or gas tank, when a heat sensor comprised of glass, plexi-glass or plastic, is compromised (i.e. melted, or broken) by temperatures in the container indicating that the flammable material is are at or near combustion levels.

10 Claims, 2 Drawing Sheets

STORAGE TANK FIRE SUPRESSION SYSTEM

This application is a continuation-in-part application and claims benefit of pending patent application Ser. No. 12/291,692 filed Nov. 13, 2008. All portions of that application are incorporated by reference.

BACKGROUND

1. Field of Invention

The present invention relates to automatically activated fire suppression system providing a system that releases fire suppressant foam, or aqueous film forming material ("AFFF") over a flammable material contained within a storage tank or gas tank, when a heat sensor comprised of glass, plexi-glass or plastic, is compromised (i.e. melted, or broken) by temperatures in the container indicating that the flammable material is are at or near combustion levels.

2. Background

Storage tanks can hold many thousands, or millions, of gallons of combustible materials such as oil and gasoline. When those combustible materials ignite, the magnitude of the fire consumes the valuable material inside and is very difficult to control. Traditional fire extinguishers are often used to tame such blazes, and require significant manpower to operate. In spite of these efforts, there are instances where combustible material within the storage tank is ignited and cannot be extinguished.

These types of fires are very difficult to control, and before the present invention, have required human intervention. Multiple fire units are necessary to control such fires, which make these types of fires extremely costly in terms of both human resources and capital. The interior combustible contents of a storage tank can ignite when lightning strikes the tank and removes the roof of the storage tank. Because such storage tanks are often placed adjacent to other such storage tanks, when the contents of one tank is ignited, the other storage tanks may ignite, causing a fire that is difficult, if not impossible control. Moreover, when the contents of a storage tank with a roof ignite, it can be difficult for firefighters to reach the contents at all.

Where storage tanks contain combustibles such as oil, fire can lead to boil over explosions that are very dangerous, and lead to the destruction of the contents as well as the surrounding environment. Additionally, storage tanks containing combustible materials are often located far from sufficient water supplies to extinguish any fires.

Other materials, such as grains and the like, contained in large amounts in storage tanks also pose special problems when ignited. These dry materials can be difficult to extinguish when ignited by environmental conditions or other factors. Additionally, these are the types of blazes that do not necessarily remove the roof, making the interior inaccessible to firefighters and the like.

Prior patents and applications, such as U.S. Patent Application Publication 2007/0019605 describe systems to extinguish liquid flammables requiring a plurality of exterior compartments to discharge a dry chemical over the flame. The above-cited publication uses dry chemical to extinguish remaining flame where the contents are a high-octane fuel and the tank has a double roof, one floating and one above. The system is portable, and thus is not an automatically deployed system. It also relies on vents within the upper roof to deliver the dry chemical to the interior of the tank.

Still, other patents, such as U.S. Pat. No. 1,337,431, describe pressure-activated extinguishers that deliver a substance to an interior of a storage tank, but do not automatically deploy by the indication that part of the contents in a storage tank are at or near combustion. The '431 patent is limited to "normally confined fire-extinguishing medium" (col. 1, Ins. 11-12). The invention is used where lightning strikes an oil tank and a fire results. The apparatus requires a plug-stem mechanism to activate the extinguisher. Such systems are complicated and provide opportunity for parts to fail, thus rendering the extinguisher useless.

Moreover, other patents describe systems necessitating a plurality of extinguishers be placed within the tank to effectively extinguish a fire (see i.e, U.S. Pat. No. 5,573,068). It would be an advantage to offer a single system that could automatically deploy and extinguish a flame within a large storage tank having a roof.

Ignition of flammable material within a storage tank creates a novel problem. Prior to ignition, the flammable material contained within the storage tank creates a substantially flat surface area that is amenable to fire suppressant foam, which will create a blanket of foam, removing oxygen from the ignited flammable material and extinguishing the flame.

There is a need for a system that can extinguish a flame within a storage tank with a roof where that can be effective with only one containment cylinder and automatically deploy rapidly in the case of combustion. There is also a need for this system to be equipped to outlet a fire suppressant foam where a flame begins in one part of the storage tank, before the flame becomes larger and consumes more of the product contained within.

The present invention alleviates many of the complications associated with storing flammable materials, especially grains and low octane fuels, in storage tanks having a roof, by using a plurality of heat sensors comprised of glass, plexi-glass or plastic located within a plurality of pipe openings that each independently activate the release of a fire suppressant material, or AFFF (which covers the entire surface area of the flammable material) that deprives the fire of necessary oxygen needed to fuel the fire, thus extinguishing the blaze within seconds.

SUMMARY OF THE INVENTION

According to one aspect of the invention, the storage tank fire suppression system contains a pressurized containment cylinder attached to a pipe that extends into a storage tank at the storage tank's sidewall, the dispensing pipe having multiple openings capable of releasing AFFF to the interior of the storage tank through at least one of the openings in the pipe connecting the pressurized containment cylinder to the interior of the container.

According to another aspect of the present invention, the storage tank fire suppression system is activated by a heat sensor, comprised of glass, plexi-glass or plastic, that is activated (i.e. broken or melted) by temperatures within the storage tank that indicate that the material within the storage tank is at temperatures at or near combustion and allow the fire suppressant foam to move through the openings within the pipe when the heat sensor is activated.

According to yet another aspect of the present invention, the storage tank fire suppression system is a fire suppression system that does not require human intervention after it is constructed.

Additionally, according to another aspect of the present invention, the storage tank fire suppression system is a cost efficient way to protect the contents of the storage tank from depleting by way of combustion, and protect other storage tanks in proximity from combustion by way of spreading fire.

According to another aspect of the invention, the storage tank fire suppression system is a cost efficient way to protect the contents of a tank containing low octane fuel or oil from depleting by way of combustion and damaging the surrounding environment.

It is another object of the present invention to extinguish a flame within a storage tank within roof automatically, without human intervention.

In yet another aspect of the invention, the storage tank fire suppression system is capable of extinguishing a small flame in one area of the storage tank through one of multiple openings within the pipe having a heat sensor that is activated in one area of the storage tank before the flame becomes larger and more product (flammable material) is destroyed.

It is an aspect of the present storage tank fire suppression system to use fire suppressant foam to cover a substantially flat surface area of flammable material to effectively extinguish a flame in a very quick manner.

Moreover, in yet another aspect of the present invention, the storage tank fire suppression system provides an AFFF, or fire suppressant foam, containment system to physically contain and extinguish a blaze within seconds, as the AFFF, or fire suppressant foam, covers the entire surface area of the flammable material, thus depriving the blaze of oxygen and extinguishing the flame.

It is an object of the present invention, in one embodiment, to follow this sequence of deployment: calculate the inner diameter of the storage tank, fill the containment cylinder with the correct portion of AFFF, or fire suppressant foam, material needed to suppress the fires for the diameter of the storage tank calculated, the rest of the cylinder is filled with a gas capable of expanding to push the AFFF, or fire suppressant material, from the cylinder, mount the self contained fire suppression unit to the top outside part of the storage tank, fit the dispensing pipe to the fire suppression unit, extending the pipe into the storage tank through a side wall, the pipe extending into at least the one quarter of the way into the center of the storage tank, and possibly across the diameter of the storage tank, and the pipe having a plurality of openings fitted with a heat sensor made of glass, plexi-glass, or plastic, the heat sensor breaking or melting when the contents of the storage tank near an opening are at or near combustion, and an agitator nozzle to allow the foam to expand at a ratio of approximately 20:1, and a choke capable of controlling the flow of the foam through the opening, the containment cylinder placed above the maximum level of material contained within the storage tank.

It is yet another object of the present invention to follow a deployment sequence to initialize the suppression sequence including: the automatic breakdown of one of the heat sensors comprised of glass or plastic in response to a heat level at or near combustion of the flammable material within the storage tank, the release of the AFFF, or fire suppressant material from the pressurized containment cylinder through a dispensing pipe having an opening equipped with an agitation nozzle and choke, the deployment of the AFFF material through the nozzle and into the interior of the storage tank, the formation of a blanket of AFFF material over the surface area of the flammable material within the storage tank, cessation of oxygen to the flame, and extinguishment of the blaze within seconds.

Additionally, in another object of the present invention, the AFFF expands in a ratio of 20:1 from the agitation nozzle, and a choke being present to control the flow of foam through the nozzle, from the plurality of openings in the dispensing pipe to cover the required suppression area.

It is another object of the present invention that the fire suppression system uses non-mechanical and electrical parts. The apparatus is temperature activated using a free-flow design with expandable gas pressure push.

BRIEF DESCRIPTION OF THE DRAWINGS

The foregoing aspects and many of the accompanying advantages of this invention will become more readily appreciated and understood by reference to the following detailed description, when taken in conjunction with the accompanying drawings, wherein.

DETAILED DESCRIPTION

The invention described in detail herein generally relates to a storage tank fire suppression system using a fire suppressant material, or AFFF to extinguish a blaze in seconds.

Figure 2:
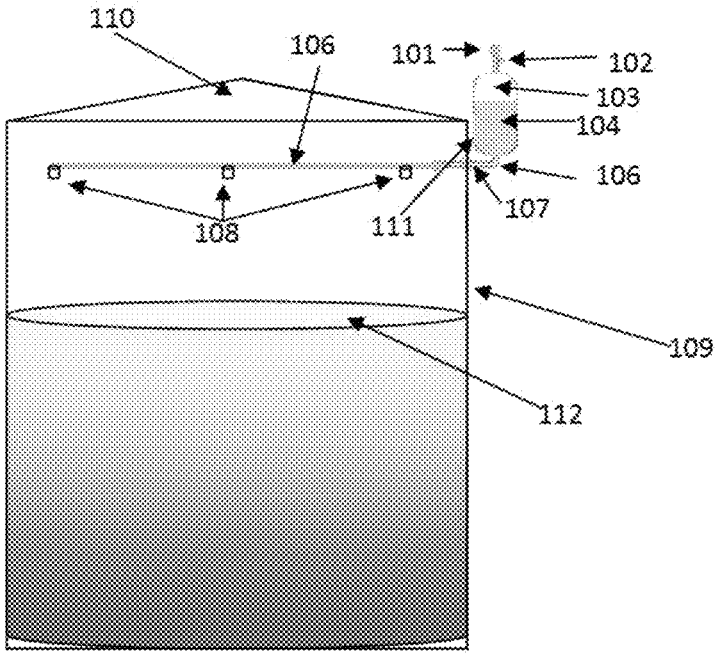
FIG. 2 is an illustration of a storage tank containing a flammable material with the fire suppression system mounted to the storage tank, according to one embodiment of the present invention.

As shown in FIG. 2, the storage tank fire suppression system has a pressurized cylinder 111 that is attached to the exterior of the storage tank 109 containing a flammable material with a substantially flat upper surface area 112. The pressurized cylinder 111 contains AFFF or fire suppressant foam 104 as well as pressurized gas 103, as in the preferred embodiment of the invention. As in the preferred embodiment, the pressurized gas 103 is nitrogen, but as is known to those skilled in the art another compressible gas that is not highly flammatory could be appropriate. It is contemplated that the size of the storage tank 109 can vary from between 150 bbl. to over 15,000 bbl. In the preferred embodiment, where the diameter of the storage tank is approximately 10 feet, approximately 16 gallons of fire suppressant foam 104 would be required to cover the substantially flat surface area of the flammable material 112. The amount of pressurized gas 103 will vary depending on the choke 115 and nozzle 114 described in FIG. 3.

For the full advantages of the present invention to be appreciated, the storage tank 109 will be equipped with a roof 110. The present invention automatically deploys the fire suppressant foam 104 when the material within the storage tank is at or near combustion. Thus, removal of the roof 110 is unnecessary for the present invention to efficiently extinguish a flame. This is a great advantage to present systems.

Figure 1:
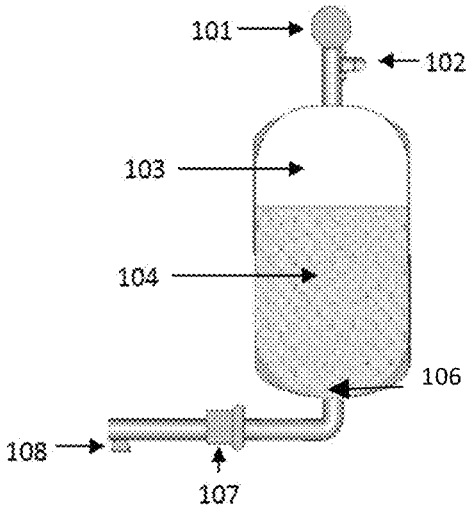
FIG. 1 is an illustration of the pressurized containment cylinder, according to one embodiment of the present invention.

As seen in FIG. 1, the pressurized cylinder 111 also contains a pressure gauge 101, and a filler intake valve 102 at the upper end. The filler intake valve 102 is capable of receiving the fire suppressant foam 104 and compressed gas 103. The pressure gauge 101 allows a user to easily monitor and maintain the cylinder in a state of readiness for deployment. The pressure will vary due to the amount of fire suppressant foam 104 and compressed gas 103. In the preferred embodiment, the pressure gauge 101 will have a "red or green" coding system such that when the pressure is appropriate and indicator points to the green portion. If the pressure should fall to below optimal levels, or is insufficient for the cylinder to function, the indicator on the pressure gauge 101 would be in the red range, alerting a user to have the cylinder serviced.

The fire suppression system is shown in its entirety in FIG. 2 as attached to the storage tank. As can be seen in FIGS. 1 and 2, a dispensing pipe 106 connects the pressurized cylinder 111 to the interior of the storage tank 109 containing a combustible, or flammable, material. The surface area of the flammable material 112 is seen in FIG. 2. The pressurized cylinder 111 is mounted on the exterior of the storage tank 109 well above the fill level of the flammable material 112. The dispensing pipe 106 extends from the pressurized cylinder 111 into the storage tank 109 and, as in one embodiment, through the diameter of the storage tank above the surface level of the flammable material 112. It should be noted that in other embodiments, the dispensing pipe 106 does not extend through the diameter of the storage tank 109. In those embodiments, the dispensing pipe 106 may be nearly any length (i.e., extend ⅛, ¼, ⅓, ⅔, ½ way through the storage tank).

Moreover, in the preferred embodiment, the dispensing pipe 106 also contains a quick connector 107 to mount the pressurized cylinder 111 to the sidewall of the storage tank 109. It is noted that mounting the pressurized cylinder 111 to the storage tank 109 can be accomplished in many other ways. For example, the pressurized cylinder 111 could be fitted with a strap that anchors to the sidewall of the storage tank 109.

A plurality of openings with glass heat sensors 108 and agitation nozzles 104 are along the dispensing pipe 106. In the preferred embodiment the dispensing pipe 106 is an approximately 1.5 inches in diameter. In other embodiments, the dispensing pipe can be between 0.5 and 3 inches in diameter. Moreover, it is contemplated that in some embodiments only one opening 108 will be used.

Figure 3:
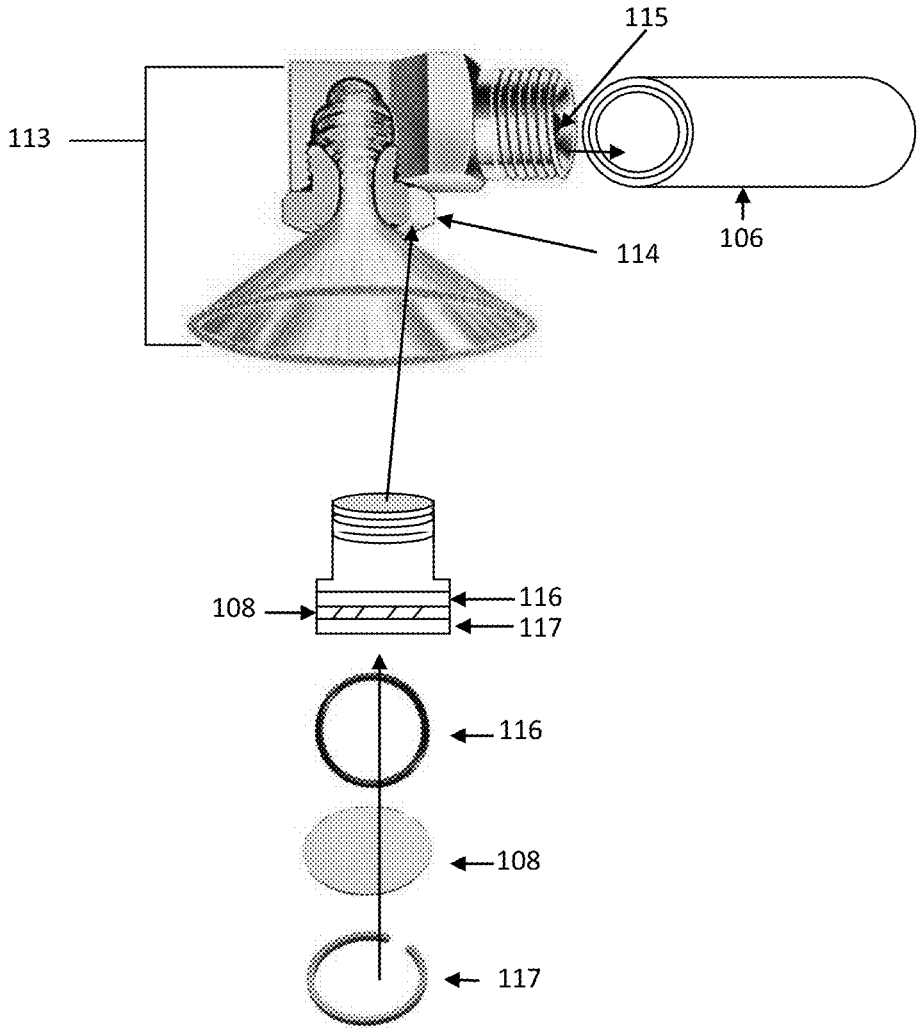
FIG. 3 is a view of a dispensing pipe opening in the fire suppression system, according to one embodiment of the present invention

The pressurized cylinder 111 is activated to release the fire suppressant foam, or AFFF material when a heat sensor 108 is triggered (see FIG. 3). The heat sensor 108 is comprised of glass, plexi-glass, or plastic that breaks down due to extreme heat, indicating combustion of the material within the storage tank, and the fire suppressant material, or AFFF material 104 is released from the pressurized cylinder 111 into the storage tank 110. In the preferred embodiment, the heat sensor made of glass or plastic 108 softens at a temperature of approximately 1,500° F. When the glass 108 softens, the pressure behind the glass 108 from the pressurized cylinder 111 is sufficient to release the fire suppressant foam 104 through the openings.

As shown in FIG. 3 a nozzle 113 is equipped at the openings with the heat sensor 108, the nozzle 113 is capable of expanding the fire suppressant foam 104 at a ratio of 20:1. The size of nozzle is dependent on the tread size of the opening in the dispensing pipe 106, allowing for a corresponding male thread. In the preferred embodiment, either an agitation nozzle or spray nozzle 113 are used to dispense the fire suppressant foam 104. Other types of nozzles that are capable of expanding the fire suppressant foam and can fit into the openings of the dispensing pipe 106 may be used, and do not depart from the scope of the invention.

FIG. 3 illustrates the complexity of an opening in dispensing pipe 106. It is noted that while the illustration shows 3 openings, it will be known to those skilled that the number of openings will be dependent on the size of the storage tank 109 (i.e., a smaller storage tank may require fewer openings such as 1 or 2, and a larger storage tank may require more openings, up to 5 or 10). It is also contemplated that some storage tanks 109 may require more than one pressurized cylinder 111 mounted to adequately extinguish a flame therein.

Where a plurality of openings are present, each opening can act as a monitor of combustion within the storage tank. Thus, if a flame is ignited at an end distal to that of the pressurized cylinder 111, the opening that is most proximal to the flame would be activated, the heat sensor 108 would melt, and the fire suppressant foam 104 would flow through the choke 115 and nozzle 114 to extinguish the flame. Each opening within the dispensing pipe 106 is fitted with its own heat sensor 108 and nozzle 114, and thus, each acts independently and automatically. The present invention can extinguish a partial flame within the storage tank 109 before the flame expands, consuming more of the material contained within.

As shown in FIG. 3, the dispensing pipe 106 has an opening in which the nozzle 104 is threaded into the opening. Within that coupling, a choke 115 is present to cut off or slow the flow of the fire suppressant foam 104 when needed (i.e., if the pressure is too high and the flow of foam needs to be slowed). Within the nozzle is another coupling containing a snap ring 117 to hold the heat sensor 108 in place, which is a plexi-glass in the preferred embodiment, and an o-ring or gasket 116 to secure an airtight fit to the nozzle 114.

It is appreciated that other forms of glass that melt or fracture at different temperatures may be amenable for use in the storage tank fire suppression system with other storage tank environments. For example, in another embodiment, a user may want the system to deploy at a lower temperature, a glass or plastic that melts at a lower temperature may be used in the heat sensor 108 position. If a user wanted a very low temperature to deploy the fire suppressant system, a polyvinyl chloride sensor could be constructed, which melts at approximately 414° F. Similarly, polytetrafluorethene melts at approximately 621° F., and could be used where the flammable material has a lower flash point (for example, grains would have a substantially lower flash point that fuels or oils) than what would activate a plexi-glass heat sensor.

In its operation, the fire suppression system has an appropriate amount of pressurized gas 103 is sufficient to force the fire suppressant foam 104, or AFFF, through the openings when the glass 108 is broken upon elevated temperatures. For example, if the user has a storage tank with a diameter of approximately 10 feet, they will want to release approximately 16 gallons of fire suppressant foam. The foam should release within approximately 5 minutes. For example, for a 210 bbl storage tank having approximately 79 sq. ft. will require 16 gal/sq. ft. of foam, or 16 gallons within a release time of 5 minutes to extinguish a flame over the surface are of the flammable material contained within the storage tank. The amount of pressurized gas, in this case nitrogen, will depend on the nozzle and choke size. It is known that nitrogen compresses to approximately 2,500 psi. Thus, the nitrogen can be variably compressed so as to accommodate the amount of fire suppressant foam needed and attain adequate pressure to move the foam through the choke and nozzle.

While the invention has been shown and described herein with reference to particular embodiments, it is to be understood that the various additions, substitutions, or modifications of form, structure, arrangement, proportions, materials, and components and otherwise, used in the practice and which are particularly adapted to specific environments and operative requirements, may be made to the described embodiments without departing from the spirit and scope of the present invention. Accordingly, it should be understood that the embodiments disclosed herein are merely illustrative of the principles of the invention. Various other modifications may be made by those skilled in the art, which will embody the principles of the invention and fall within the spirit and the scope thereof.

We claim:

1. A storage tank fire suppression system comprising:

a storage tank of a size between approximately 150 bbl. and 15,000 bbl. containing a flammable material with a substantially flat surface area, and said storage tank being fitted with a roof;

a pressurized cylinder having a pressure gauge, and a filler intake valve for filling the pressurized cylinder, said pressurized cylinder containing fire suppressant foam and pressurized gas, wherein the gas is under sufficient pressure to force the fire suppressant foam through an opening in a dispensing pipe extending from the bottom of the pressurized cylinder and extending into the storage tank, said dispensing pipe passing through a sidewall of the storage tank and said pressurized cylinder being mounted to a exterior sidewall of the storage tank above the flammable material contained within the storage tank;

the dispensing pipe extending from the bottom of the pressurized cylinder and into the interior of the storage tank and said dispending pipe being substantially parallel to the substantially flat surface area of the flammable material, said dispensing pipe having a quick connector to mount the pressurized cylinder, and at least one opening where the dispensing pipe is in the interior of the storage tank, said at least one opening having a heat sensor, a nozzle and a choke to slow the flow of the fire suppressant foam;

wherein when the flammable material, or a subset of the flammable material, is at or near combustion, the heat sensor is activated releasing the fire suppressant foam under pressure behind the opening, the compressed gas expanding and expelling the fire suppressant foam through the choke so that the foam flows through the nozzle, the nozzle expanding the foam at an approximately 20 to 1 ratio, said fire suppressant foam covering the flammable material and extinguishing any flame.

2. The storage tank fire suppression system of claim 1, wherein the fire suppressant foam is AFFF.

3. The storage tank fire suppression system of claim 1, wherein the storage tank is approximately 10 feet in diameter and approximately 16 gallons of fire suppressant foam will cover the substantially flat surface area of the flammable material.

4. The storage tank fire suppression system of claim 1, where in the dispensing pipe extends through the diameter of the storage tank, having openings spaced between approximately 3 feet from each other, each opening comprising a heat sensor, choke and nozzle where if any heat sensor is activated, the pressurized gas expands, pushing the fire suppressant foam through the choke and nozzle, covering the substantially flat surface area of the flammable material.

5. The storage tank fire suppression system of claim 1, wherein the compressed gas is nitrogen.

6. The storage tank fire suppression system of claim 1, wherein the heat sensor is comprised of glass, plexi-glass, or plastic.

7. The storage tank fire suppression system of claim 1, wherein the dispensing pipe has a diameter between approximately 0.5 and 3 inches in diameter.

8. A storage tank fire suppression system comprising:

a storage tank of a size of approximately 210 bbl. containing a flammable material with a substantially flat surface area, and said storage tank being fitted with a roof;

a pressurized cylinder having a pressure gauge, and a filler intake valve for filling the pressurized cylinder, said pressurized cylinder containing approximately 16 gallons fire suppressant foam and pressurized nitrogen, wherein the gas is under sufficient pressure to force the fire suppressant foam through an opening in a dispensing pipe extending from the bottom of the pressurized cylinder and extending into the storage tank, said dispensing pipe passing through a sidewall of the storage tank and said pressurized cylinder being mounted to a exterior sidewall of the storage tank;

the dispensing pipe having a diameter of approximately 1.5 inches and extending from the bottom of the pressurized cylinder and into the interior of the storage tank and said dispending pipe being substantially parallel to the substantially flat surface area of the flammable material and extending across one quarter of the diameter of the storage tank, said dispensing pipe having a quick connector to mount the pressurized cylinder, and approximately 3 openings where the dispensing pipe is in the interior of said storage tank, said openings each having a heat sensor comprised of plexi-glass, a nozzle and a choke to slow the flow of the fire suppressant foam;

wherein when the flammable material, or a subset of the flammable material, is at or near combustion, the heat sensor in at least one of said openings is activated, releasing the fire suppressant foam under pressure behind the opening, the compressed gas expanding and expelling the fire suppressant foam through the choke so that the foam flows through the nozzle, expanding the foam at an approximately 20 to 1 ratio, said fire suppressant foam covering the flammable material and extinguishing any flame, and wherein each opening is activated independently and automatically.

9. The storage tank fire suppression system of claim 8, wherein the openings in the dispensing pipe are spaced approximately 2 to 5 feet in between each other.

10. The storage tank fire suppression system of claim 8, wherein the fire suppressant foam is AFFF.

* * * * *